US005411187A

United States Patent [19]

Schwab

[11] Patent Number: 5,411,187

[45] Date of Patent: May 2, 1995

[54] AEROSOL SPRAY CONTAINER AND SPRAY DIRECTOR

[76] Inventor: William Schwab, 60 Caryl Ave., Yonkers, N.Y. 10705

[21] Appl. No.: 267,588

[22] Filed: Jun. 29, 1994

[51] Int. Cl.[6] ..... B05B 15/06

[52] U.S. Cl. ..... 222/538

[58] Field of Search ..... 222/402.1, 530, 538, 222/539

[56] References Cited

U.S. PATENT DOCUMENTS

| | | | |
|---|---|---|---|
| 1,329,184 | 1/1920 | Hyams | 222/538 |
| 2,684,181 | 7/1954 | Neuner | 222/538 X |
| 2,908,446 | 10/1959 | Strouse | 222/402.1 X |
| 4,096,974 | 6/1978 | Haber et al. | 222/538 X |
| 4,305,528 | 12/1981 | Craig | 222/530 X |
| 4,520,951 | 6/1985 | Facey | 222/538 X |
| 4,728,007 | 3/1988 | Samuelson et al. | 222/538 X |
| 4,819,838 | 4/1989 | Hart, Jr. | 222/538 |
| 4,858,792 | 8/1989 | de Laforcade | 222/538 X |
| 4,911,329 | 3/1990 | Canini | 222/539 X |
| 4,941,594 | 7/1990 | Larson | 222/538 X |
| 4,972,973 | 11/1990 | Davis | 222/538 X |
| 5,058,783 | 10/1991 | Antonelli | 222/538 |
| 5,143,263 | 9/1992 | Newell | 222/402.1 X |

FOREIGN PATENT DOCUMENTS

| | | | |
|---|---|---|---|
| 99931 | 7/1923 | Switzerland | 222/538 |

*Primary Examiner*—Kevin P. Shaver

*Attorney, Agent, or Firm*—Amster, Rothstein & Ebenstein

[57] ABSTRACT

An aerosol spray container includes a container defining first and second non-communicating open-topped chambers. The first chamber is air-tight and configured and dimensioned to hold a liquid to be dispensed as an aerosol spray, and the second chamber is configured and dimensioned to receive therein a longitudinally extending spray director. An aerosol valve operatively closes the open top of the first chamber and is actuatable to release aerosol spray therefrom. The valve is configured and dimensioned to receive therein one end of the spray director, whereby aerosol spray released through the valve exits the opposite end of the director, thereby to guide and direct the aerosol spray.

13 Claims, 1 Drawing Sheet

AEROSOL SPRAY CONTAINER AND SPRAY DIRECTOR

BACKGROUND OF THE INVENTION

The present invention relates to an aerosol spray container and more particularly to an aerosol spray container provided with a spray director.

It is well known to provide an aerosol spray container with a spray director which may be used to guide the aerosol spray emerging from the aerosol valve of the container along a predetermined path to facilitate efficient application of the aerosol spray into a particular location or area which may otherwise be inaccessible or difficult to reach. The spray director may be referred to in the art by a variety of different terms including the following: guide, dispensing tube, directing tube, discharge conduit, or the like.

While the director is typically a relatively rigid or strongly resilient, longitudinally extending member, it may alternately be flexible as disclosed in U.S. Pat. 4,096,974. While a flexible director is relatively easy to store within the cap or cover assembly of the spray can, as disclosed in U.S. Pat. No. 4,096,974, the more conventional relatively rigid or strongly resilient director presents a storage problem. Most commonly, the aerosol spray container is purchased with the director simply taped to a side of the container and, after purchase, it is up to the user to retape it to the container after each use. U.S. Pat. Nos. 4,520,951; 4,819,838; and 4,941,594 disclose aerosol spray containers which have especially designed caps or covers adapted to releasably receive a director and maintain it with the container for storage purposes, but the director is stored in each case on the outer periphery of the container where it can easily be accidentally dislodged and separated therefrom. U.S. Pat. No. 4,728,007 discloses a cap for an aerosol container which includes a volume within the cap for storing a short director, thereby to avoid this accidental dislocation problem, but the length of the director which can be thus stored is severely limited and, furthermore, the loss of the cap also results in loss of the director.

Thus, the need-remains for an aerosol container which provides a storage location for a director which meets a variety of different requirements. The storage location must accommodate a longitudinally extending director which itself may be non-flexible (i.e., substantially rigid) and almost as long as the spray container. It must store the director in a location within the radial periphery of the aerosol container and separate from the cover so that the director cannot be accidentally separated from the aerosol container and would not be lost even if the cap is lost. It furthermore preferably positions the director such that the director does not interfere with normal use of the container when the director is not required and permits capping in the container to both prevent accidental discharge of the contents and retention of the spray director.

Accordingly, an object to the present invention is to provide an aerosol spray container adapted to store a spray director, with the major portion of the length of the spray director disposed within the aerosol container and thus within the radial periphery of the container.

Another object is to provide such a container which can store a longitudinally extending, substantially rigid director without bending the same.

A further object is to provide such a container which can store a director having a length almost equal to that of the container itself.

It is also an object of the present invention to provide such a container wherein the director in its storage location does not interfere with the normal use of the aerosol container when the director is not required.

It is a further object to provide such a container which is of simple and economical construction.

SUMMARY OF THE INVENTION

It has now been found that the above and related objects of the present invention are obtained in an aerosol spray container comprising an aerosol container and an aerosol valve. The aerosol container defines first and second non-communicating open-topped chambers. The first chamber is air-tight and configured and dimensioned to hold a liquid to be dispensed as an aerosol spray, and the second chamber is configured and dimensioned to receive therein a longitudinally extending spray director. The aerosol valve operatively closes the open top of the first chamber and actuatable to release aerosol spray therefrom. The valve is configured and dimensioned to receive therein one end of the spray director, whereby aerosol spray released through the valve exits the opposite end of the director, thereby to guide and direct the aerosol spray.

In a preferred embodiment, the second chamber is smaller in volume than the first chamber, open only at the top thereof, tubular in configuration, substantially rigid, and surrounded by the first-chamber save at the open top thereof. The second chamber is configured and dimensioned to receive therein a substantial portion of the length of the director, with the remaining portion of the length of the director extending upwardly beyond the open top of the second chamber.

The second chamber is preferably configured, dimensioned and positioned relative to the valve and the director such that, when the director is received in the second chamber, the remaining portion of the director extending upwardly beyond the open top of the second chamber does not interfere with actuation of the valve, the release of aerosol spray or the capping of the container.

In another preferred embodiment, the container additionally includes means for releasably maintaining the director in the second chamber. The maintaining means comprises a cover releasably secured to the container and, when so secured, covering both the aerosol valve and the remaining portion of the length of the director extending upwardly beyond the open top of the second chamber.

The invention further encompasses the container in combination with a longitudinally extending spray director, at least a substantial portion of the length of the director being held in the second chamber, with the remaining portion of the length of the director extending upwardly beyond the open top of the second chamber. Preferably the second chamber retentively but releasably receives the director therein.

DESCRIPTION OF THE DRAWING

The above and related objects, features and advantages of the present invention will be more fully understood by reference to the following detailed description of the presently preferred, albeit illustrative, embodiments of the present invention when taken in conjunction of the accompanying drawing wherein.

DETAILED DESCRIPTION OF THE PREFERRED EMBODIMENTS

Figure 1:
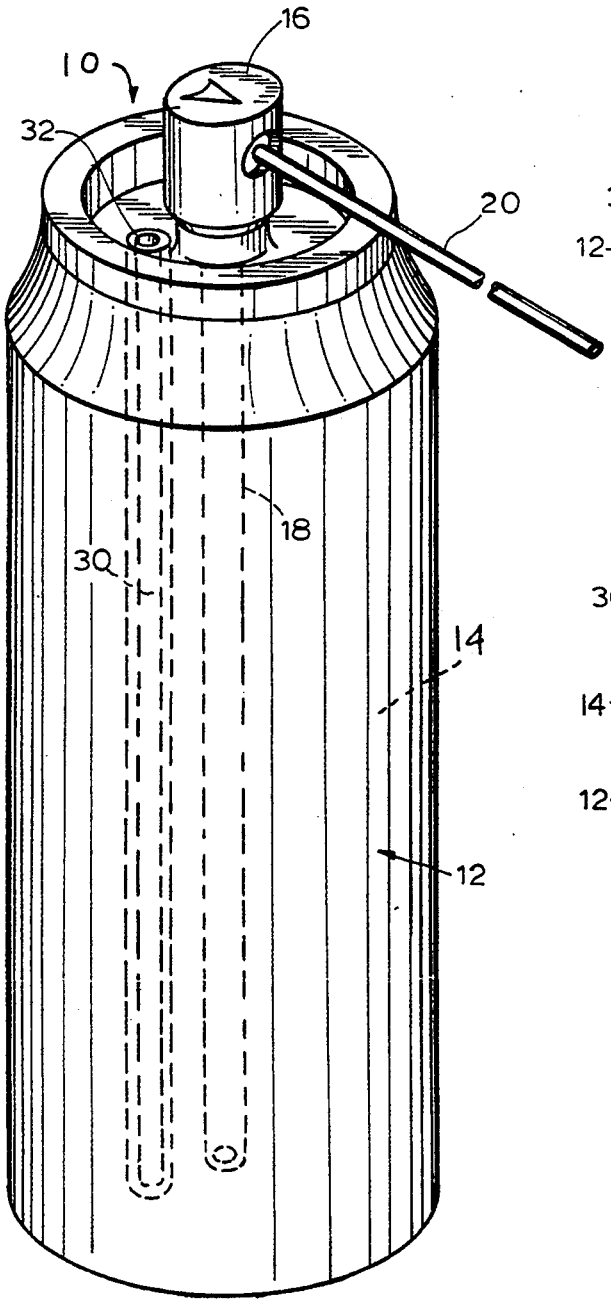
FIG. 1 is a fragmentary isometric view of an aerosol spray container according to the present invention with one end of the spray director shown being received within the aerosol valve in a position of use.

Referring now to the drawing, therein illustrated is an aerosol spray container generally designated by the reference numeral 10. In its conventional aspects, the aerosol spray container 10 includes a container 12 which defines an open-topped chamber 14 which is air-tight and configured and dimensioned to hold therein a liquid to be dispensed as an aerosol spray. An aerosol valve generally designated 16 is secured to and closes the open top of the chamber 14, the valve 16 being in fluid communication with the interior of the chamber 14 via an open-ended tube 18 so that the aerosol valve 16 upon actuation releases aerosol spray from the interior of the chamber 14. The valve 16 is configured and dimensioned to optionally receive one end of a longitudinally extending spray director generally designated 20, as illustrated in FIG. 1, so that aerosol spray released through the valve 14 exits the opposite or distal end of the director 20, thereby to guide and direct the spray into a desired volume or location without dissipation thereof.

Depending upon the intended application, the director 20 may be generally rigid, resilient, or flexible. The length of the director 20 may be almost as great as the height of the container itself or substantially shorter.

As is also conventional for an aerosol spray container 10, a cap or cover 22 (see FIG. 2) may be provided. The cover is releasably securable to the top of container 12 so as to cover the aerosol valve 16 and prevent its accidental actuation during storage. As the container 12, director 20, and cover 22 described above are conventional and well know to those in the aerosol spray art, a further description thereof is not necessary herein.

Turning now to the novel aspects of the present invention, the container 12 further defines a second open-topped chamber 30 configured and dimensioned to receive therein the longitudinally extending spray director 20. The second or storage chamber is smaller in volume than and does not communicate with the first or liquid-holding chamber. Preferably the storage chamber 30 is configured as a hollow tube closed at the bottom and open only at the top. It has an inner radius which releasably receives therein the director 20 and is just sufficient to permit easy passage of the director 20 into and out of the storage chamber 30. The storage chamber 30, except for its open top 32, is surrounded by the liquid-containing chamber 14 and is preferably rigid so that it does not become deformed under the pressure existing within the liquid-containing chamber 14.

If desired, the outer dimensions of the director 20 and the inner dimensions of the storage chamber 30 may be selected so that the director 20 is retentively but releasably received within the storage chamber 30 and will not become actually separated therefrom if the container 10 is inverted during storage. However, when the director 20 is substantially flexible, a snug fit between the director 20 and its storage chamber 30 may lead to insertion difficulties. Accordingly, the cap 22 which is releasably securable to the container 10 is adapted to releasably maintain the director 20 in the storage chamber 30 by covering not only the aerosol valve 16 (as is conventional), but also the portion of the length of the director 20 extending upwardly from the open top 32 of the storage chamber 30.

Figure 2:
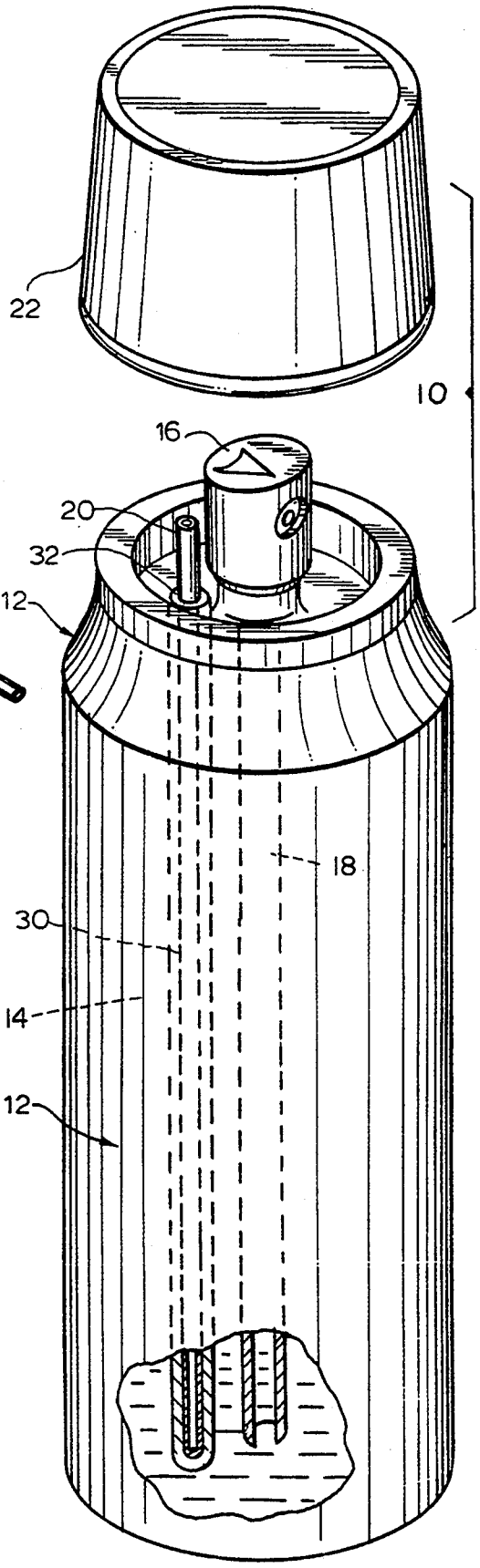
FIG. 2 is an isometric view of the container of FIG. 1 with the director shown in its storage location, and a cover therefor, with portions removed to reveal details of internal construction.

Referring now in particularly to FIG. 2, the storage chamber 30 is configured and dimensioned to receive therein a substantial portion of the length of the director 20, with the remaining portion of the length of the director 20 extending upwardly beyond the open top 32 of the storage chamber 30. The storage chamber 30 is configured, dimensioned, and positioned relative to the aerosol valve 16 and the director 20 such that, when director 20 is received in the storage chamber 30, the remaining portion of the director 20 extending upwardly beyond the open top 32 of the storage chamber 30 does not interfere with the normal actuation of the valve 16 or the release of the aerosol spray as a result thereof. This may be accomplished either by having a non-rotatable aerosol valve which always emits aerosol spray in a spray path direction which does not cross the axis of the director 20 in storage chamber 30 or by having the top of the director 20 when it is in the storage chamber 30 disposed below the level of the spray path. In any case, the length of the storage chamber 30 is preferably substantially shorter than the length of the director 20 so that the portion of the length of the director 20 extending above the open top 32 of the storage chamber 30 is sufficient to enable easy manual grasping of the top end of the director 20 to facilitate its removal from the storage chamber 30.

Depending upon the particulars of the spray container 10 and the director 20, the storage chamber 30 may simply be a hollow tube of metal sealed at the bottom end and extending through an aperture in the top of the container 12, with the open end 32 thereof protruding approximately 0.25–0.50 inch upwardly from the top surface of the container 10. The portion of container 12 defining the aperture is then sealed to the tube to prevent the escape of the fluid from the aperture. This is conveniently done prior to filling of the liquid-receiving chamber 14 with pressurized liquid.

It will be appreciated that the storage chamber 30 permits even a rigid director 20 to be stored within the peripheral boundary of what has the appearance of a conventional aerosol spray container 10, including a cap 22 therefor, so that the director 20 is essentially incapable of accidental separation from the container 10 and yet is easily removed therefrom for deployment and use. The volume of the storage chamber 30 is very small relative to the volume of the liquid-receiving chamber 14 so that the usable interior volume of the liquid-receiving chamber 14 is not substantially diminished.

To summarize, the present invention provides an aerosol spray container adapted to store a spray director, with the major portion of the length of the spray director disposed within the aerosol container and thus within the radial periphery of the container. The container can store a longitudinally extending rigid director without bending the same, even where the length of the director is almost equal to that of the container itself, the director in its storage location not interfering with the normal use of the aerosol container when the director is not required. The container is of simple and economical construction.

Now that the preferred embodiments of the present invention have been shown and described in detail, various modifications and improvements thereon will become readily apparent to those skilled in the art. Accordingly, the spirit and scope of the present invention is to be construed broadly and limited only by the appended claims, and not by the foregoing specification.

I claim:

1. An aerosol spray container comprising:

(A) a container defining first and second non-communicating open-topped chambers, said first chamber being air-tight and configured and dimensioned to hold a liquid to be dispensed as an aerosol spray, and said second chamber being configured and dimensioned to receive therein a substantial portion of the length of a longitudinally extending spray director, with the remaining portion of the length of the director extending freely upwardly beyond the top of said second chamber, said second chamber being smaller in volume than said first chamber, open only at the top thereof and surrounded by said first chamber save at the top thereof; and (B) an aerosol valve operatively closing the top of said first chamber and actuatable to release aerosol spray therefrom, said valve being configured and dimensioned to receive therein one end of the spray director, whereby aerosol spray released through said valve exits the opposite end of the director, thereby to guide and direct the aerosol spray.

2. The container of claim 1 wherein said valve has a nozzle, and the director extends above said first chamber.

3. The container of claim 2 wherein the director does not extend as high as said nozzle.

4. The container of claim 1 wherein said second chamber is tubular in configuration.

5. The container of claim 1 wherein said second chamber is substantially rigid.

6. The container of claim 1 wherein the spray director is generally rigid and unstressed when in said second compartment.

7. The container of claim 1 wherein said second chamber is configured, dimensioned and positioned relative to said valve and the director such that, when the director is received in said second chamber, the portion of the director extending upwardly beyond the top of said second chamber does not interfere with actuation of said valve or the release of aerosol spray.

8. The container of claim 1 additionally including means for-releasably maintaining the director in said second chamber, said maintaining means comprising a cover releasably secured to said container and, when so secured, covering both said aerosol valve and the portion of the director extending upwardly beyond the top of said second chamber.

9. The container of claim 1 additionally including means for releasably maintaining the director in said second chamber.

10. The container of claim 9 wherein said maintaining means is a cover releasably secured to said container and, when so secured, covering both said aerosol valve and said top of said second chamber.

11. The container of claim 1 in combination with a longitudinally extending spray director, at least a substantial portion of the length of said director being releasably held in said second chamber, with the remaining portion of the length of said director extending upwardly beyond the open top of said second chamber.

12. The container of claim 11 wherein said second chamber releasably receives said director therein.

13. An aerosol spray container comprising:

(A) a longitudinally extending spray director;

(B) a container defining first and second non-communicating open-topped chambers, said first chamber being air-tight and configured and dimensioned to hold a liquid to be dispensed as an aerosol spray, and said second chamber being smaller in volume than said first chamber, open only at said top thereof, tubular in configuration, substantially rigid, and surrounded by said first chamber save at said top thereof; said second chamber being configured and dimensioned to receive therein a substantial portion of the length of said director, with the remaining portion of the length of said director extending freely upwardly beyond the first chamber and said top of said second chamber;

(C) an aerosol valve operatively closing said top of said first chamber and actuatable to release aerosol spray therefrom, said valve being configured and dimensioned to receive therein one end of said director, whereby aerosol spray released through said valve exits the opposite end of said director, thereby to guide and direct the spray; and (D) means for releasably maintaining said director in said second chamber including a cover releasably secured to said container and, when so secured, covering both said aerosol valve and said remaining portion of the length of said director extending upwardly beyond said top of said second chamber; said second chamber being configured, dimensioned and positioned relative to said valve and said director such that when said director is received in said second chamber, said remaining portion of said director extending upwardly beyond said top of said second chamber does not interfere with actuation of said valve or the release of aerosol spray.

* * * * *